US006507799B2

(12) United States Patent
Steffen

(10) Patent No.: US 6,507,799 B2
(45) Date of Patent: Jan. 14, 2003

(54) METHOD AND APPARATUS FOR REDUCING MICROPROCESSOR SPEED REQUIREMENTS IN DATA ACQUISITION APPLICATIONS

(75) Inventor: Michael A. Steffen, Rockford, IL (US)

(73) Assignee: Honeywell International Inc., Morristown, NJ (US)

( * ) Notice: Subject to any disclaimer, the term of this patent is extended or adjusted under 35 U.S.C. 154(b) by 60 days.

(21) Appl. No.: 09/792,996

(22) Filed: Feb. 26, 2001

(65) Prior Publication Data

US 2002/0120419 A1 Aug. 29, 2002

(51) Int. Cl.[7] ..... G06F 15/00; D06F 35/00

(52) U.S. Cl. ..... 702/96; 68/23.2; 73/490; 327/311; 377/23; 340/988

(58) Field of Search ..... 702/94, 96, 33, 702/56, 141, 147, 190; 68/23.2, 12.04, 12.06; 73/490; 8/158, 159; 340/988

(56) References Cited

U.S. PATENT DOCUMENTS

| | | | | |
|---|---|---|---|---|
| 3,799,348 A | | 3/1974 | Mazza | 210/144 |
| 3,983,035 A | | 9/1976 | Arkeveld et al. | 210/138 |
| 4,000,658 A | * | 1/1977 | Schmidt | 73/490 |
| 4,157,781 A | | 6/1979 | Maruyama | 494/7 |
| 4,322,641 A | * | 3/1982 | Packard | 327/311 |
| 4,694,156 A | * | 9/1987 | Swanberg | 250/214 RC |
| 4,991,247 A | | 2/1991 | Castwall et al. | 8/158 |
| 5,150,314 A | * | 9/1992 | Garratt et al. | 702/94 |
| 5,280,660 A | | 1/1994 | Pellerin et al. | 8/158 |
| 5,325,677 A | * | 7/1994 | Payne et al. | 68/12.04 |
| 5,376,063 A | | 12/1994 | Greenstein | 494/37 |
| 5,490,436 A | | 2/1996 | Coyne et al. | 74/573 |
| 5,561,993 A | | 10/1996 | Elgersma et al. | 68/23.2 |
| 5,582,040 A | | 12/1996 | Khan | 68/23.2 |
| 5,692,313 A | | 12/1997 | Ikeda et al. | 34/58 |
| 5,715,731 A | | 2/1998 | Koch | 74/573 |
| 5,761,932 A | | 6/1998 | Kim | 68/23.2 |
| 5,761,933 A | | 6/1998 | Kim et al. | 68/23.2 |
| 5,765,402 A | | 6/1998 | Ikeda et al. | 68/12.06 |
| 5,850,748 A | | 12/1998 | Kim et al. | 68/23.2 |
| 5,862,553 A | | 1/1999 | Harberl et al. | 8/159 |
| 5,870,907 A | | 2/1999 | Cho | 68/23.1 |
| 5,893,280 A | | 4/1999 | Honda et al. | 68/12.06 |
| 5,913,951 A | | 6/1999 | Herr et al. | 8/158 |
| 5,921,148 A | | 7/1999 | Howell | 74/573 |
| 5,979,236 A | | 11/1999 | Hong et al. | 73/458 |
| 6,029,300 A | * | 2/2000 | Kawaguchi et al. | 8/159 |
| 6,047,428 A | | 4/2000 | Min | 8/159 |
| 6,082,151 A | | 7/2000 | Wierzba et al. | 68/23.2 |
| 6,129,768 A | | 10/2000 | Johnson et al. | 8/159 |
| 6,130,928 A | * | 10/2000 | Jamzadeh et al. | 377/23 |
| 6,148,647 A | | 11/2000 | Kabeya et al. | 68/140 |

* cited by examiner

*Primary Examiner*—John S. Hilten
*Assistant Examiner*—John Le
(74) *Attorney, Agent, or Firm*—Kris T. Fredrick

(57) ABSTRACT

A method and apparatus for improving microprocessor data acquisition. Noise in analog signals is removed by a low pass filter with a variable cutoff frequency controlled to cut off all frequencies above a frequency range of interest. The filtered signal is sampled by an analog-to-digital converter at a sampling rate which is variable and controlled to sample at a rate that is at least two times the low pass filter cutoff frequency thereby reducing the rate at which data is passed to a microprocessor and reducing the need for speed in the microprocessor's processing.

24 Claims, 2 Drawing Sheets

METHOD AND APPARATUS FOR REDUCING MICROPROCESSOR SPEED REQUIREMENTS IN DATA ACQUISITION APPLICATIONS

BACKGROUND OF THE INVENTION

This invention relates generally to the filtering and sampling of data to improve microprocessor data acquisition. More particularly, this invention relates to reducing the speed requirements for microprocessors that acquire data for realtime processing of force and acceleration measurements from rotating structures such as a washing machine tub or drum.

In the appliance market, market research shows the need for bigger capacity washing machines. To fill this need, the tub has to be larger to accommodate larger washing loads. The tub is also known as the spinner. Under certain conditions, the clothing load in the tub will become unbalanced. This causes the spinning tub to vibrate and move out of its normal position. In the United States, when the size of the tub is increased, the size of the cabinet which houses the tub and other washing machine components is also increased. The cabinet size is increased with the tub size to maintain spatial clearances between the tub and the cabinet. These clearances are required so that an unbalanced load in the tub will not cause the tub to slam into the cabinet as the tub rotates, for example, during the spin cycle or tumbling cycles. However, in the European market, a fixed washing machine cabinet size is required. Increasing the tub size while maintaining a fixed cabinet size leaves little room for movement of the tub during a spin cycle with an unbalanced load.

To keep the tub from contacting the sides of the cabinet while it is rotating, a system for dynamically "balancing the tub" during the spin cycle has been developed. Balancing the tub involves adding weight to certain areas of the tub to counter balance an unevenly distributed load of clothes or other material being washed. This is done by using a tub with a series of "fluid pockets" in the front and back of the tub. These pockets are strategically filled with fluid during the spin cycle to counterbalance the wash load and keep the tub from shaking and contacting the sides of the cabinet. This technology is more fully described in U.S. Pat. No. 5,561,993, entitled "Self Balancing Rotatable Apparatus," assigned to Honeywell Inc. The fluid could comprise one of many types of fluid or combinations thereof but preferably is a 70% by weight water and 30% by weight calcium chloride mixture.

Those skilled in the art of balancing rotating structures, such as tires on automobiles, are well aware of the use of computers in balancing. Typically, sensors near the rotating structure send data to a computer which calculates an appropriate correction to balance the structure. In the case of tires, the computer instructs the technician to attach an amount of weight at a certain location on the tire rim.

Balancing a washing machine tub as it is rotating is much more complicated than balancing a tire as it must be performed without the luxury of stopping the rotating structure to mount weight in the appropriate position. Dynamic balancing must occur in realtime; therefore, timely data acquisition and the ability to process that information quickly are of utmost importance. Force and acceleration sensors near the tub convey data to a microprocessor which determines the extent of the unbalance, computes the corrective remedy, and controls the implementation of that remedy.

Present methods of collecting and converting data to a digital form require that large amounts of data be processed in a short period of time to balance the tub. The quantity of data is large because massive oversampling is required to provide the measurement accuracy necessary to balance the tub. Oversampling in this context means that many more data points are sampled within a period of time, thus sending a stream of data to a computer or microprocessor at a very high rate. The computer, in turn, must process this data in realtime as it cannot store the data for later processing. The computer must take each piece of data and process it before proceeding to the next piece of data. Each processing step may require several processing BUS cycles during which computer commands are executed. Therefore, the faster the data comes into the computer, the faster the computer must be to keep up with the flow of information to generate an appropriate corrective remedy. To make matters more difficult, the faster the washing machine tub spins, the faster data must be collected to provide an accurate representation of the unbalanced condition of the tub. Sampling frequencies are directly correlated with the rate of rotation of the washing machine tub. A washing machine tub may spin at 1,100 revolutions per minute (RPM). At these high rotation speeds, data from the rotating tub must be sampled at a very high rate or frequency in order to construct an accurate picture of the actual forces and accelerations being exerted by the tub. The oversampling required by prior technology is in the range of 1 to 5 kHz, which can only be accomplished with higher-priced microprocessors. Therefore, oversampling requires the use of microprocessors with processing speeds as high as 100 to 200 MHz, causing the cost of the entire washing machine to become prohibitively high.

U.S. Pat. No. 5,561,993 (the "'993 patent") illustrates the data acquisition difficulties found in the prior art. In the '993 patent, a fixed-frequency low-pass filter is used before the data is sampled and a narrow tunable band pass filter is employed to further try to eliminate noise in the signal. This band pass filter is implemented through software in the microprocessor. Therefore, the microprocessor must process a large quantity of digital data to remove the noise before it can begin to analyze the data for its intended purpose. As such, the prior art methods require prohibitively fast and needlessly complex microprocessors to perform tasks such as described herein.

Moreover, sampling at a fixed frequency has significant disadvantages. For example, in the prior art, data is sampled at a fixed frequency for all rates of rotation of the washing machine tub. In this example, as the rotating tub slows down, the number of data points per revolution of the tub increases. This in turn increases the number of BUS cycles per revolution required by the microprocessor to calculate a correction to an unbalanced condition. In practice, unbalance conditions often manifest themselves at these intermediate speeds. Therefore, the microprocessor may actually work harder at the lower rates of rotation of the structure, and a faster microprocessor may be required to balance rotating tubs even at lower and intermediate speeds.

A need exists for a device which reduces the microprocessor speed requirements for data acquisition while maintaining the integrity of the data. This will allow slower microprocessors to be used in applications that otherwise would require fast microprocessors, improving the realtime analysis of data intensive washing machine balancing. Furthermore, a need exists to have the ratio of BUS cycles per revolution be a constant at any rate of revolution of the tub.

BRIEF DESCRIPTION OF THE DRAWINGS

The accompanying figures, in which like reference numerals refer to identical or functionally-similar elements throughout the separate views and which are incorporated in and form part of the specification, further illustrate the present invention and, together with the detailed description of the invention, serve to explain the principles of the present invention.

Figure 1:
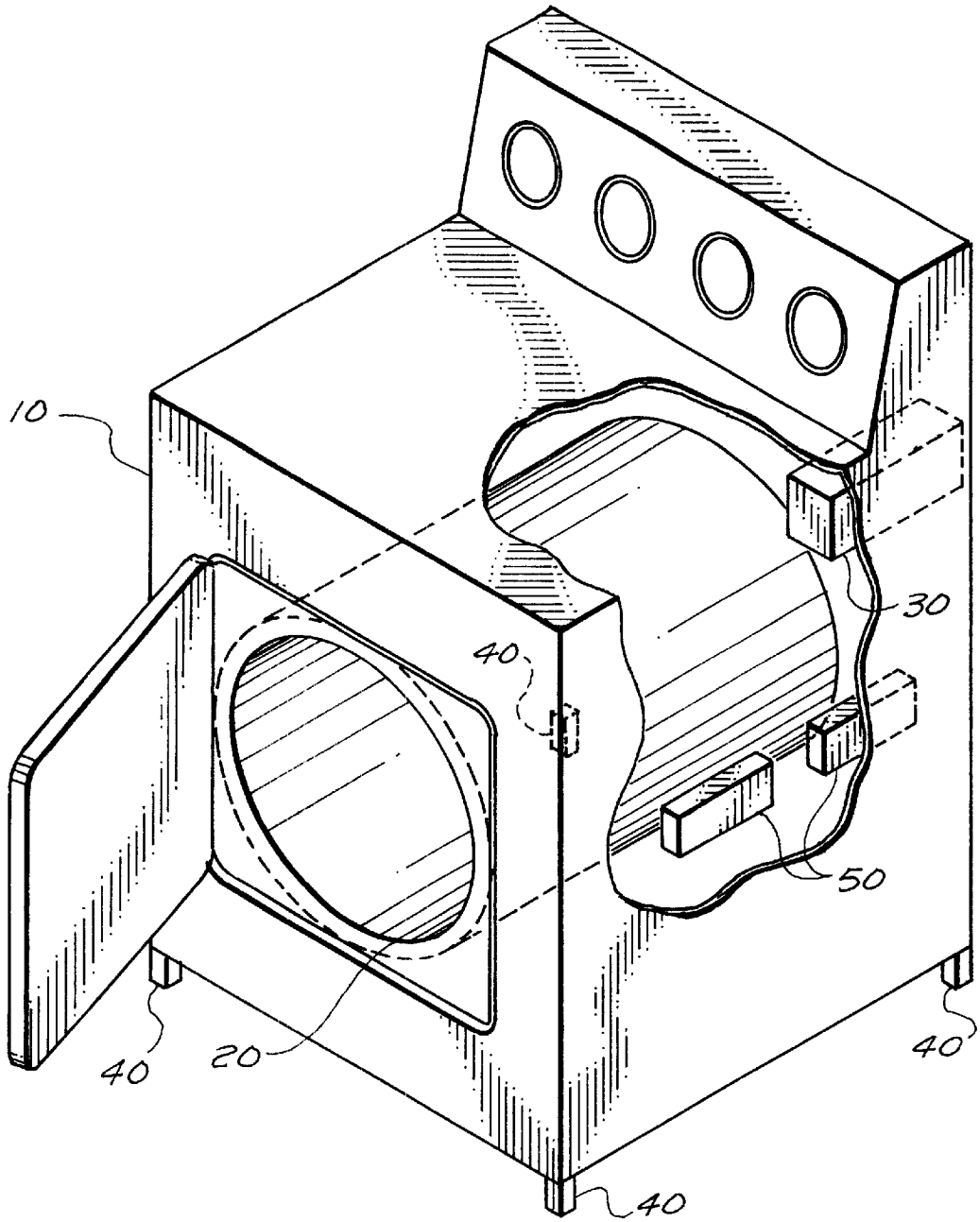
FIG. 1 is a cutaway drawing of an existing washing machine and tub.

It should be understood that the drawings are not necessarily to scale and that the embodiments are illustrated using graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

SUMMARY OF THE INVENTION

The following summary of the invention is provided to facilitate an understanding of some of the innovative features unique to the present invention, and is not intended to be a full description. A full appreciation of the various aspects of the invention can be gained by taking the entire specification, claims, drawings, and abstract as a whole.

The present invention allows for the transmission of a rotating structure's unbalanced condition data to a microprocessor by filtering out all of the higher frequencies in the incoming data before sampling the data and passing the data to the microprocessor. A variable low pass filter ("LPF") is used to variably remove all frequencies above a cutoff or threshold frequency. This cutoff frequency is determined based on the speed of rotation of the tub and is proportional thereto. The ability to vary the cutoff frequency with the variation in the rate of rotation of the tub makes it possible to limit the passing of data at all times to only those frequencies that are of interest at a particular rate of rotation and substantially reduces or eliminates aliasing contamination.

Next, sampling is performed by an analog to digital converter ("ADC"), which samples the low pass filtered incoming data at a sampling rate which is also proportional to the rotation of the tub. With the removal of the noise in the extraneous higher frequencies, the analog to digital converter achieves accurate data sampling while sampling at a rate that is at least two times the cutoff frequency. Removal of data signals above the frequencies of interest removes the need to oversample at 1 kHz to 5 kHz. Filtering the sensor signals with the variable LPF makes it possible to sample the signals with the appropriate accuracy at or slightly above the Nyquist frequency. In washing machine applications, for example, this ranges from 5 to 200 Hz. The sampled data is provided to the microprocessor at this slower rate while still maintaining the integrity of the sampling and forming an accurate digital data stream to represent the acceleration and forced measurements. The microprocessor can process this data in fewer BUS cycles, in fewer BUS cycles per tub revolution, and, therefore, at a lower processor speed. Thus, the microprocessor can more quickly calculate the needed balancing adjustments to the wash load and more quickly implement those adjustments.

Therefore, the present invention provides a much needed answer to the need for realtime balancing of washing machines using data acquisition methods that allow for simple, low speed and low cost microprocessors which can timely process force and acceleration data.

The novel features of the present invention will become apparent to those of skill in the art upon examination of the following detailed description of the invention or can be learned by practice of the present invention. It should be understood, however, that the detailed description of the invention and the specific examples presented, while indicating certain embodiments of the present invention, are provided for illustration purposes only because various changes and modifications within the scope of the invention will become apparent to those of skill in the art from the detailed description of the invention and claims that follow.

DETAILED DESCRIPTION OF THE INVENTION

Systems and methods in accordance with various aspects of the present invention provide an improved data acquisition tool for use in balancing rotating structures. In this regard, the present invention may be described herein in terms of functional block components and various processing steps. It should be appreciated that such functional blocks may be realized by any number of hardware, firmware, and/or software components configured to perform the specified functions. For example, the present invention can employ various integrated circuit components, such as memory elements, digital signal processing elements, look-up tables, databases, and the like, which carry out a variety of functions under the control of one or more microprocessors or other control devices. Such general techniques and components that are known to those skilled in the art are not described in detail herein.

It should further be understood that the exemplary process or processes illustrated may include more or less steps or may be performed in the context of a larger processing scheme. Furthermore, the various flowcharts or block diagrams presented in the drawing figures are not to be construed as limiting the order in which the individual process steps may be performed.

FIG. 1 is an isometric exemplary drawing of a washing machine 10 showing in a cutaway view certain internal components of the washing machine. Tub or spinner 20 is the part of the washing machine that receives the clothing and other material to be washed and within which the water, detergent, and other clothes washing chemicals are combined and agitated. An electronic means or circuitry 30 is also included in the housing or control panel of the washing machine. It is to be understood that the drawing of the washing machine in FIG. 1 and the placement of components shown is exemplary in nature and these components could be changed in their shape and relative relationship to each other, as is well known in the art of washing machines.

It is desirable to determine the current status of a rotating structure such as a spinning tub to determine if the tub and its contents are in balance or, if the tub is not in balance, to determine the nature of the imbalance and to calculate and implement a corrective remedy to the imbalance. Various sensors (not shown) are coupled to the tub 20 to measure the speed of the rotation of the tub 20. Other sensors 40 and 50 are placed within cabinet 10 and preferably coupled to cabinet 10 to measure force and acceleration resulting from unbalanced conditions of the tub 20. The force and acceleration sensors can be placed to obtain force and acceleration information in all three dimensions. Although the details regarding the placement of sensors and the calculations and implementation of a balancing remedy for an unbalanced rotating structure are not part of this invention, further disclosure relating to these topics may be found the '993 patent.

A sensor (not shown) senses the rate of rotation of the tub 20. This sensor can be one of any number of sensors which are well known in the art for measuring the rate of rotation of structures. These rotation sensors can include magnetic sensors, optical sensors, mechanical levers, voltage or current sensors monitoring the motor, electromagnetic sensors or any other device which can create a signal representing the rate of rotation. Preferably, a Hall effect switch is used for measuring the rate of rotation. For example, the Honeywell Sensing and Control Hall effect switch 2SS52M is used to sense the rotations per minute and convey a data signal 100 to a microprocessor 200.

Figure 2A:
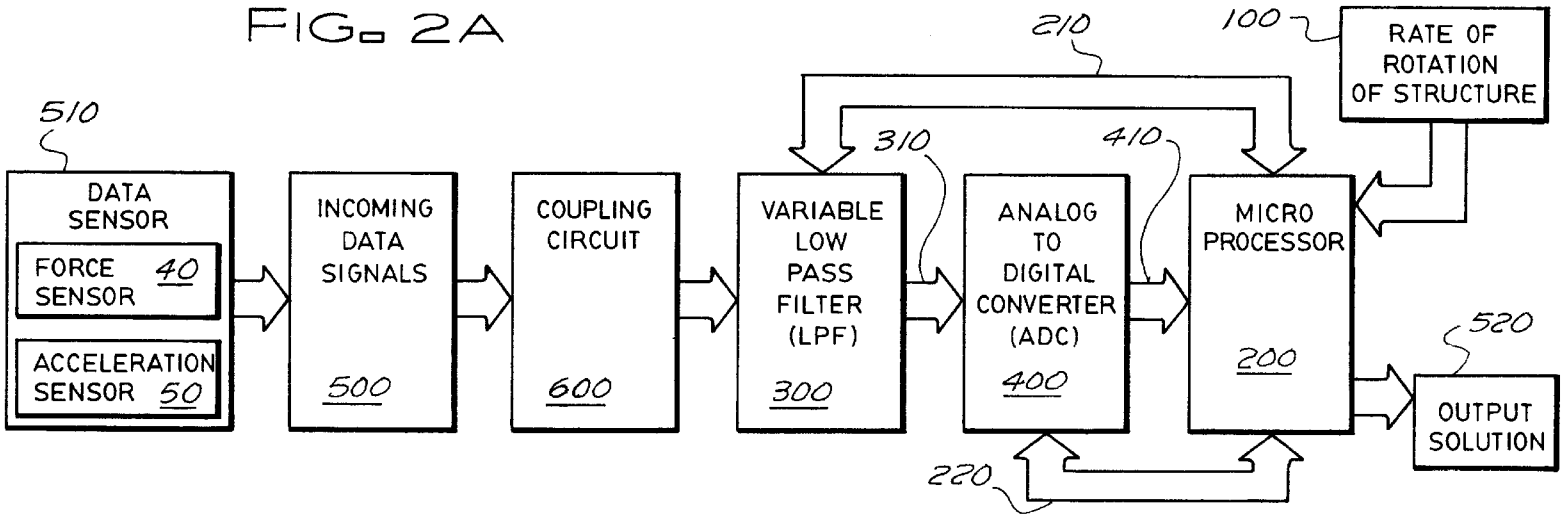
FIG. 2A is a block diagram showing a preferred embodiment of the present invention.

Washing machine 10 may rotate the tub 20 at a constant rate ranging from 80 revolutions per minute (RPM) to as high as 1,100 RPM. As seen in FIG. 2A, the microprocessor 200 receives the first signal 100 representing the rate of rotation of the tub 20, and uses signal 100 to calculate a cutoff frequency and a sampling frequency proportional to the rate of rotation. The cutoff frequency is approximately equal to the rate of rotation of the tub and is proportional to the rate of rotation of the tub and can be calculated, for example, by the following formula: rate of rotation in RPM/60. The microprocessor 200 then provides this calculated cutoff frequency as a control signal 210 to variable low pass filter (LPF) 300. The microprocessor calculates the sampling frequency, which is also proportional to the rate of rotation of the tub and proportional to the cutoff frequency and is at least two times (twice) the cutoff frequency. The microprocessor 200 provides a sampling frequency control signal 220 representative of the calculated sampling frequency to variable analog-to-digital converter (ADC) 400.

Figure 2B:
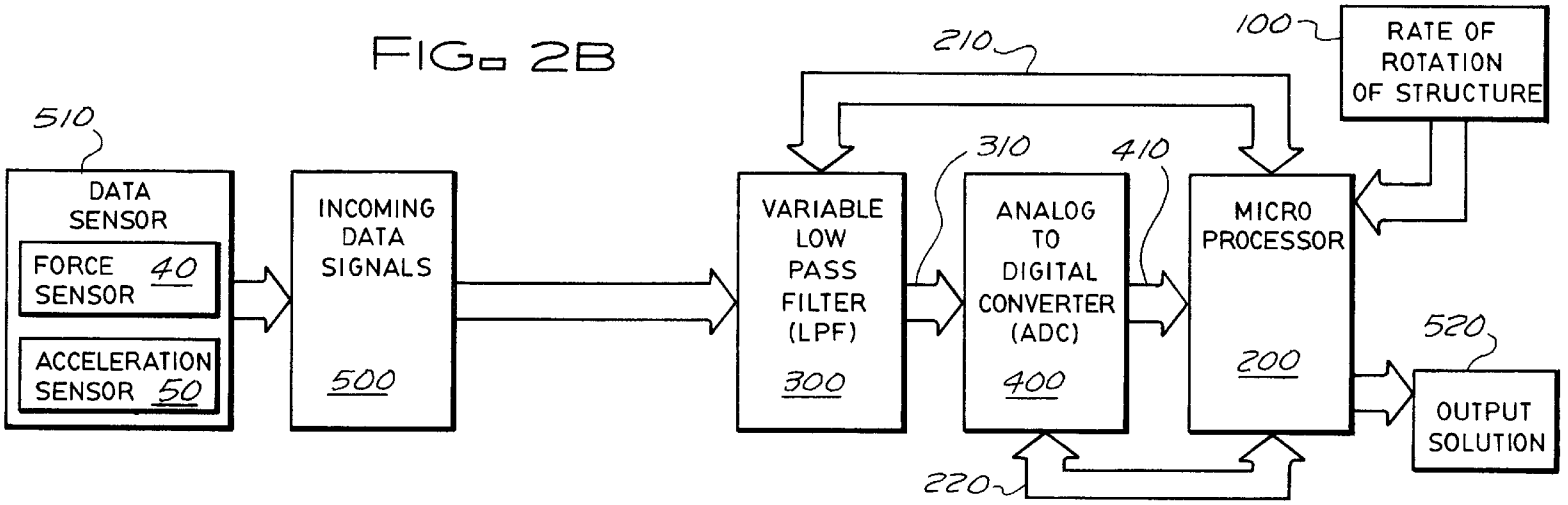
FIG. 2B is a block diagram showing a preferred embodiment of the present invention without the coupling circuit.

A plurality of sensors, collectively 510 and individually shown as 40 and 50, provide data signals or information 500 as an unbalanced condition signal. This unbalanced condition signal 500 indicates the nature of any unbalance condition existing in the tub 20 through data which includes force or acceleration data that can be used by microprocessor 200 to determine if the tub is in or out of balance. Multiple sensors can be used in various locations around the tub to take measurements in different directions. Although the number and placement of sensors may vary, preferably four force sensors 40 and four acceleration sensors 50 would be used. Preferably, the acceleration sensors 50 are attached to the inside right side of the cabinet, shown in FIG. 1 with two X-Y accelerometer sensors per package. Preferably, the force sensors 40 are attached to the feet of the washing machine although other locations will suffice. Each sensor provides either a force signal or an acceleration signal individually to microprocessor 200 as described below. Turning to FIG. 2A, incoming data signals from either a force or acceleration sensor, collectively 510, optionally enters a coupling circuit 600 which removes the voltage offset. Transmitting the signal through the coupling circuit 600 is not essential to the operation of the present invention (see FIG. 2B); however, it is preferable that the coupling circuit 600 be used to center the signal about a reference point. The reference point is preferably 2.5 Volts, although other reference points can be used. The output of coupling circuit 600 is then transmitted to a low pass filter 300 which has a variable cutoff frequency. Alternatively, the incoming data signals 500 could be transmitted directly to the low pass filter 300 if the coupling circuit 600 is not used.

The rotating tub of the washing machine creates force and acceleration data signals 500 through the sensors 510 at frequencies that are closely associated with the rate of rotation of the tub 20. The data signals 500 can also include other information at higher frequencies, but this information is not relevant to the balancing of the rotating tub 20. Therefore, information in data signals 500 above the frequency associated with the rate of rotation of the tub 20 is not useful and is treated as noise. In the prior art, this noise obscures the parts of the signal of interest and makes it more difficult to obtain correct readings through the incoming data signals. In order to overcome the noise in the prior art, the prior art methodologies massively oversampled the data signal. For example, to perform sampling of the force or acceleration data on a spinning washing machine tub, oversampling rates of 1,000 Hz to 5,000 Hz would be required. The use of a variable low pass filter (LPF) with a variable cutoff frequency, however, makes it possible to cut off all frequencies above the frequency associated with the rate of rotation of the tub 20. The cutoff frequency control signal 210 supplied to the variable low pass filter 300 continually removes all frequencies in the incoming data signals 500 that are above the frequencies associated with the rate of rotation of the tub.

It is essential that the LPF 300 have a variable cutoff frequency controlled by the cutoff frequency control signal 210, which varies proportionally with the tub 20 rotation speed. If the cutoff frequency of the LPF 300 were fixed at any particular frequency, due to the nature of the changing speeds of the washing machine tub 20 or like rotating structure, the LPF 300 would either cut off frequencies that are of interest or allow frequencies to pass that contain noise over much of the range of speed of rotation of the tub. The variable cutoff frequency LPF 300 can be one of any number of standard variable low pass filters, preferably a National Semiconductor MF4CN-50.

The filtered signal 310 is next transmitted to the ADC 400 which samples the filtered signal 310 at a sampling rate to create a sampled signal 410, which is a digital signal representative of the filtered signal 310. When a signal, such as a sine wave, is sampled, care should be taken to sample enough of the signal to be able to accurately reconstruct a digital signal which represents the sine wave. Failure to take a sufficient number of sampling points results in a phenomenon called "aliasing", where a reconstructed digital signal does not accurately reflect the incoming analog signal. Those familiar in the art of sampling data know that aliasing can be avoided and sampling is most efficient at the Nyquist frequency, which is two times the highest frequency component of the input spectrum. In this case, the highest frequency component of the input spectrum would be the variable low pass filter cutoff frequency; and thus, sampling at two times that frequency minimizes or eliminates the aliasing effect. Sampling at the Nyquist frequency also eliminates the need to oversample and allows slower sampling to occur in an application such as that of measuring a washing machine tub at 5 Hz to 200 Hz, which is significantly lower than the 1,000 Hz to 5,000 Hz sampling rate required without having first filtered the signal with a LPF having a variable cutoff frequency associated with the rate of rotation of the tub.

The digital sampled signal 410 is provided to microprocessor 200, preferably at a rate of 5 Hz to 200 Hz. Microprocessor 200 operating at less than 20 MHz, preferably 10 to 20 MHz, could process the information and perform the tasks 520 required to balance the washing machine tub 20. In contrast, if no low pass filter variable cutoff frequency is used, oversampling would be required and the microprocessor speed would have to be considerably higher to handle such data (e.g., .such a microprocessor may need to be as fast as 100 to 200 MHz). Therefore, the present invention makes it possible to incorporate a microprocessor into the design which is considerably slower than the type of microprocessor required under prior art solutions. The freedom to use slower microprocessors simplifies the design of the washing machine controls and makes the washing machine as a whole less expensive. Also, the use of the variable cutoff frequency LPF 300 and the variable sampling rate ADC 400 remove the need to sample undesirable noise and makes it possible to avoid oversampling.

It is also important to note that, as the tub 20 increases its rate of rotation, the force or acceleration signals 500 will be created at a higher frequency and the frequencies of interest will be proportionally raised. Therefore, the LPF cutoff frequency will need to increase and the sampling frequency will also need to increase. Analog-to-digital converters are well known in the art of data sampling and many different analog-to-digital converters could be selected to perform the task described above, but preferably a 12 to 16 bit ADC could be used, and most preferably a 12 bit National Semiconductor ADC12138 ADC could be used.

It is possible that ADC 400 could have a fixed sampling frequency designed to correspond with the maximum anticipated rotation speed of the rotating tub. However, such a design is not preferable because, at lower or intermediate tub rotational speed, use of a variable sampling frequency allows the data to be sampled at a slower rate and, therefore, the data provided to the microprocessor is provided at a slower rate, freeing up the microprocessor to perform other commands and computations. Furthermore, at the lower or intermediate tub rotation speeds, the microprocessor may actually have to do more computations to be able to balance the washing machine tub. Also, when using a fixed sampling frequency, as the rate of rotation of the washing machine tub shows down, the number of data points per tub revolution increases. The microprocessor must perform a set number of commands for each data point received by the microprocessor, and each command requires a set number of BUS cycles or clock cycles. Therefore, with a fixed sampling frequency, the number of BUS cycles per revolution increases as the tub rate of rotation slows down. Using a variable sampling frequency, the number of data point samples per revolution of the tub remains constant. Therefore, use of a variable sampling frequency allows the number of BUS cycles required to process one revolution worth of data to be a constant value.

The loads and unbalance conditions in a washing machine change rapidly as fluid is added and removed and as water is extracted from the wash load. Corrections to unbalanced loads may need to be calculated for each revolution of the tub. By forcing the number of BUS cycles to process data from one tub revolution to be a constant value, it is easier to correctly design and choose the right speed of microprocessor; and that speed can be slower than would otherwise be selected without the variable sampling frequency. Therefore, it is a benefit to have both a smaller number of data points and a constant number of data points per tub revolution.

It should be appreciated that, although the present design has been described using a single microprocessor 200, multiple microprocessors could be used to perform the separate functions of receiving the first input signal indicative of the rotation rate of the tub, to calculate the cutoff frequency control signal and the sampling frequency control signals, and to receive the sampled digital signal 410 for processing, and to adjust the 520 balance condition of the tub. Also, it is understood that the source of data signals need not be limited to sensors and can include any source of analog signals creating the second signals 500. Microprocessor 200 takes the sampled digital signals 410 and calculates the current balance condition of the tub and the nature of the adjustment that needs to be made to bring the tub into balance. Microprocessor 200 next commands other commands of the 520 task (not shown) to implement the calculated balance correcting solution.

It should also be appreciated that, although the use of this data acquisition tool is described in the context of balancing a washing machine tub, the apparatus and method described herein are also applicable in other areas of data acquisition and/or balancing a rotating structure. Furthermore, the rate of data acquisition need not be limited to the rate of rotation of a structure but could be any desired rate of data acquisition. It is also anticipated that the aforementioned invention could be built using discreet components or an integrated circuit package, and although any number of microprocessors could be used, preferably an NEC uPD70F3033AGC-8EU model would be used.

The embodiments and examples set forth herein are presented to best explain the present invention and its practical application and to thereby enable those skilled in the art to make and utilize the invention. Those skilled in the art, however, will recognize that the foregoing description and examples have been presented for the purpose of illustration and example only. Other variations and modifications of the present invention will be apparent to those of skill in the art, and it is the intent of the appended claims that such variations and modifications be covered. The description as set forth is not intended to be exhaustive or to limit the scope of the invention. Many modifications and variations are possible in light of the above teaching without departing from the spirit and scope of the following claims. It is contemplated that the use of the present invention can involve components having different characteristics as long as the principle, the elimination of all undesirable signal frequencies above a frequency of interest and variable sampling rates to digitize the data, is followed. It is intended that the scope of the present invention be defined by the claims appended hereto, giving full cognizance to equivalents in all respects.

What is claimed is:

1. An apparatus for reducing microprocessor speed requirements in data acquisition applications comprising:

a low pass filter having a variable cutoff frequency;

an analog to digital converter in communication with the low pass filter;

at least one microprocessor in communication with the analog to digital converter for receiving a first signal, the first signal representing a rate of rotation of a structure, the at least one microprocessor determining and providing a low pass filter cutoff frequency control signal to the low pass filter for controlling the variable cutoff frequency of the low pass filter, wherein said low pass filter cutoff frequency control signal is based on said rate of rotation of said structure;

the low pass filter removing frequencies above the variable cutoff frequency from a second signal creating a filtered second signal;

the filtered second signal being sampled by the analog to digital converter at a sampling rate creating a sampled second signal; and the sampled second signal being provided to one of the at least one microprocessor.

2. The apparatus of claim 1, further comprising at least one sensor in communication with the at least one microprocessor, the sensor generating the first signal.

3. The apparatus of claim 2, the analog to digital converter having a variable sampling frequency, and the at least one microprocessor determining and providing a sample frequency control signal to the analog to digital converter for controlling the variable sampling frequency of the analog to digital converter.

4. The apparatus of claim 3, the second signal representing an unbalanced condition signal.

5. The apparatus of claim 4, further comprising a coupling circuit in communication with at least one data sensor and the low pass filter for removing a voltage offset from the second signal before the second signal is filtered by the low pass filter.

6. The apparatus of claim 5, the low pass filter cutoff frequency being approximately equal to the rate of rotation of the structure and the sampling frequency being at least twice the low pass filter cutoff frequency.

7. The apparatus of claim 6, the microprocessor further calculating and implementing a solution to balance said rotating structure wherein said rotating structure comprises a washing machine tub.

8. An apparatus for balancing a rotating structure while the structure is rotating, comprising:

at least one microprocessor;

at least one sensor in communication with the rotating structure for measuring and providing at least one unbalanced condition signal; and means for monitoring a rotation of the rotating structure, the means transmitting a signal to one of the at least one microprocessor;

the at least one microprocessor calculating and generating a cutoff frequency control signal corresponding to the rate of rotation; and the at least one microprocessor calculating and directing the balancing of the rotating structure based upon the at least one unbalanced condition signal, the at least one unbalanced condition signal having been processed by a low pass filter controlled by the cutoff frequency control signal and having been processed by an analog to digital converter sampling at a sampling frequency.

9. The apparatus of claim 8, further comprising the analog to digital converter sampling at the sampling frequency determined by a sampling frequency control signal calculated to be proportional to the rate of rotation of the rotating structure by the at least one microprocessor.

10. The apparatus of claim 9, the low pass filter cutoff frequency being approximately equal to the rate of rotation of the rotating structure and the sampling frequency being at least twice the low pass filter cutoff frequency.

11. The apparatus of claim 10, further comprising a coupling circuit for removing a voltage offset from the at least one unbalanced condition signal before the at least one unbalanced condition signal is filtered by the low pass filter.

12. The apparatus of claim 11, the rotating structure comprising a washing machine tub.

13. A method for reducing microprocessor speed requirements in a data acquisition application with varying rates of data acquisition comprising the steps of:

receiving a first signal proportional to a desired rate of data collection;

providing a source of data signals creating a second signal;

variably filtering the second signal, creating a filtered data signal, to remove frequencies higher than a cutoff frequency proportional to the desired rate of data collection;

sampling the filtered data signal at a sampling rate to create a sampled signal; and providing the sampled signal to a microprocessor.

14. The method of claim 13, the source of data signals comprising a sensor measuring an unbalanced condition of a washing machine tub.

15. The method of claim 14, the sampling rate being variable and proportional to the desired rate of data collection and the desired rate of data collection being proportional to a rate of rotation of the washing machine tub.

16. The method of claim 15, the cutoff frequency being approximately equal to the rate of rotation of the washing machine tub and the sampling rate being at least twice the cutoff frequency.

17. The method of claim 16, further comprising the step of removing a voltage offset from the second signal before filtering the second signal.

18. The method of claim 17, the first signal representing a rate of rotation of the washing machine tub.

19. A method for reducing microprocessor speed requirements comprising the steps of:

continuously measuring a first signal and providing the first signal to a microprocessor;

continuously calculating a sample frequency corresponding to the first signal;

continuously calculating a cutoff frequency corresponding to the first signal;

using the calculated cutoff frequency to control the cutoff frequency of a variable low pass filter;

using the calculated sample frequency to control the sampling rate of an analog to digital converter;

filtering a second signal by the low pass filter at the calculated cutoff frequency, and sampling a resulting filtered signal by the analog to digital converter at the calculated sampling frequency, and providing a resulting sampled signal to the microprocessor.

20. The method of claim 19, the first signal representing a rate of rotation of a rotating structure, the calculated cutoff frequency being approximately equal to the rate of rotation of the rotating structure and the calculated sample frequency being at least twice the calculated cutoff frequency.

21. The method of claim 20, the second signal comprising an unbalanced condition signal for the rotating structure, the structure comprising a washing machine tub.

22. The method of claim 21, further comprising the step of removing the voltage offset from the second signal before filtering the second signal.

23. The method of claim 22, wherein a number of BUS cycles per revolution of the washing machine tub is constant for any rate of rotation of the washing machine tub.

24. A control system for a washing machine, the washing machine having a rotating tub, the control system comprising:

a low pass filter having a variable cutoff frequency and configured to remove frequencies above said variable cutoff frequency from a data signal to create a filtered data signal, wherein said low pass filter is configured to vary said variable cutoff frequency according to a low pass filter cutoff frequency control signal;

an analog to digital converter in communication with the low pass filter and configured to sample said filtered data signal at a sampling rate to create a sampled data signal, wherein said sampling rate is controlled by a sampling rate control signal; and a microprocessor configured to receive said sampled data signal; said at least one microprocessor further configured to receive a rub rotation signal, where said tab rotation signal represents a rate of rotation of the rotating tub, said at least one microprocessor further configured to determine, based on said rate of rotation of the rotating tub, and to provide a low pass filter cutoff frequency control signal to said low pass filter, and wherein said at least one microprocessor is further configured to determine, based on said rate of rotation of the rotating tub, and to provide a sampling rate control signal to said analog to digital converter.

* * * * *